United States Patent [19]

Turner et al.

[11] Patent Number: 4,642,852

[45] Date of Patent: Feb. 17, 1987

[54] DUST EXTRACTOR FOR DRAWFRAME

[75] Inventors: Nicholas J. Turner, Altrincham; Geoffrey A. Ogden, Rochdale; Richard S. Bridge, Ramsbottom, all of England

[73] Assignee: National Research Development Corporation, London, England

[21] Appl. No.: 744,271

[22] Filed: Jun. 13, 1985

[30] Foreign Application Priority Data

Jun. 14, 1984 [GB] United Kingdom ..... 8415214

[51] Int. Cl.[4] ..... D01H 5/62; D01H 11/00

[52] U.S. Cl. ..... 19/236; 19/245; 19/263

[58] Field of Search ..... 19/236, 245, 263

[56] References Cited

U.S. PATENT DOCUMENTS

| | | | |
|---|---|---|---|
| 3,141,203 | 7/1964 | Whitehurst et al. | 19/263 |
| 3,247,553 | 4/1966 | Norman | 19/245 |
| 3,377,665 | 4/1968 | Kincaid | 19/263 |
| 3,443,283 | 5/1969 | Whitehurst | 19/263 X |
| 3,885,272 | 5/1975 | Marzoli | 19/245 |
| 4,306,337 | 12/1981 | Sutter | 19/263 |
| 4,357,793 | 11/1982 | Gasser et al. | 19/263 X |

FOREIGN PATENT DOCUMENTS

| | | |
|---|---|---|
| 3016409 | 11/1981 | Fed. Rep. of Germany . |
| 0399262 | 3/1966 | Switzerland . |
| 0715873 | 9/1954 | United Kingdom . |
| 0751043 | 6/1956 | United Kingdom . |
| 0973607 | 10/1964 | United Kingdom . |
| 0997845 | 7/1965 | United Kingdom . |
| 1432477 | 4/1976 | United Kingdom . |
| 2016533 | 9/1979 | United Kingdom . |

*Primary Examiner*—Louis K. Rimrodt

*Attorney, Agent, or Firm*—Cushman, Darby & Cushman

[57] ABSTRACT

Dust extraction apparatus for a drawframe of the type comprising a pair of table-like creels (3), on each of which are disposed a set of bollards (5) arranged such that multiple slivers of cotton can be drawn in parallel relationship into a set of differential drafting rollers (2), the dust extraction apparatus comprising a plurality of air inlet vents positioned, for example, on each creel table at or around each bollard and at or around each guide-fork (20), and further air inlet vents, for example, at or around each set of differential drafting rollers, each vent being connected to outlet ducting (6, 9, 12) providing substantially constant suction and incorporating a filter adapted to continuously remove particles of dust etc. from the air within the ducting at a substantially constant rate.

11 Claims, 5 Drawing Figures

DUST EXTRACTOR FOR DRAWFRAME

This invention relates to a dust extractor for a drawframe of the type used in yarn manufacture.

A drawframe is utilised in yarn manufacture to admix slivers of flocculate material such as cotton so that a single homogeneous sliver is produced for subsequent processing into twisted yarn. A known type of drawframe comprises a pair of table-like creels, on each of which is disposed a set of eight bollards arranged such that multiple slivers of e.g. cotton can be drawn in parallel relationship into a set of differential drafting rollers wherein the slivers are admixed and drafted to produce a suitably blended sliver which is then stored in a sliver can. Each bollard serves to guide a respective unmixed sliver which is fed from a sliver can onto the creel table through a guide-fork.

It is known that large amounts of foreign bodies, including dust, are present in the flocculate material, so that when the drawframe is operated, correspondingly large amounts of dust and fibres are liberated from each sliver of the material, at each change of direction along its path of travel on the drawframe, in particular, around each guide-fork, each bollard, each set of differential drafting rollers, and also around the sliver cans. The dust and fibres liberated into the atmosphere constitute a serious health hazard for operators of the machine and other persons working in its vicinity. Although it is desirable to remove dust from the atmosphere, known techniques of achieving this end have been found to be unsatisfactory either because of the high cost of installing extraction equipment or the inconvenience caused by the presence of the extraction equipment to the operator of the machine in hindering free access to all parts thereof. For example, it has been proposed to provide a hood over the working area but the presence of such a hood has been found to severely hamper the accessability to the machine by the operator thereof.

It is also known to utilise suction hoods around the drafting rollers which are connected to a rotatable fan. When the fan rotates, air and dust carried by it is drawn via the suction hoods through the ducting and is deposited upon a stationary filter which is an integral part of the drawframe. With such a filtration system it is found that when it is clean, particles of dust pass straight through the filter and are thus blown back into the environment where the operator works. Dust is known to be a prime cause of lung disorders in such an environment. Conversely, when the filter becomes clogged, such particles of dust tend increasingly to be trapped by the filter but, on the other hand, the ability of the extraction unit to removal all of the dust-laden air from around the drafting rollers becomes increasingly impaired. Consequently, it is found that when the extractor fan is operating at maximum efficiency it is blowing dangerous particles of dust back into the atmosphere and when the extractor is operating less efficiently, i.e. when the filter becomes clogged, it is unable to remove from the atmosphere all of the dust laden air from around the drafting rollers.

It is an object of the present invention to provide dust extraction for a drawframe in which the aforementioned disadvantages are obviated.

According to the present invention there is provided dust extraction apparatus on a drawframe, the apparatus comprising a plurality of individual air inlet vents disposed at a plurality of spaced positions about the drawframe along the sliver path where dust and other pollutant particles may be generated, and connected via outlet ducting to one or more suction and collection means adapted continuously to remove particles from the surrounding air, characterised in that said air inlets are so diposed that free access to operating parts of the apparatus is not hindered thereby.

In particular, the apparatus comprises air inlet vents on each creel table at or around each bollard, and at or around each guide-fork, and further air inlet vents at or around the or each set of differential drafting rollers.

The suction in the outlet ducting may conveniently be substantially constant such that particles of dust etc. are removed from the air of the outlet ducting at a substantially constant rate.

Conveniently, the vents on each creel table may be connected to outlet ducting fixed below each table. Each bollard may itself comprise an air inlet vent, having a bore through which air may be drawn into the ducting.

Conveniently, damping means may be provided in the ducting to "tune" the apparatus for optimum performance with a variety of sliver materials. The damping means may comprise a plate slidable within the ducting to restrict the flow of air therein. The plate may be operable between the drafting roller vents and the creel table vents such that air flow from the drafting roller vents can be controlled.

The invention will now be described, by way of example only, with reference to the accompnaying drawings in which.

Figure 1:
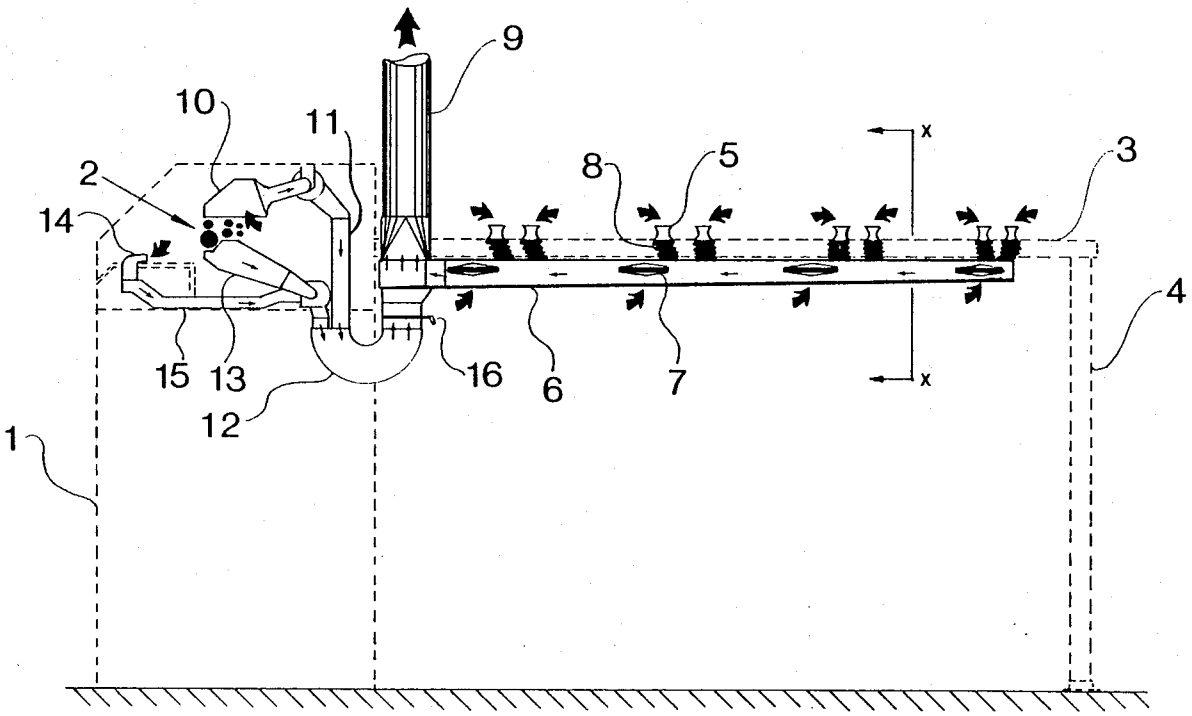
FIG. 1 shows schematically in side elevation apparatus according to the invention.
Figure 2:
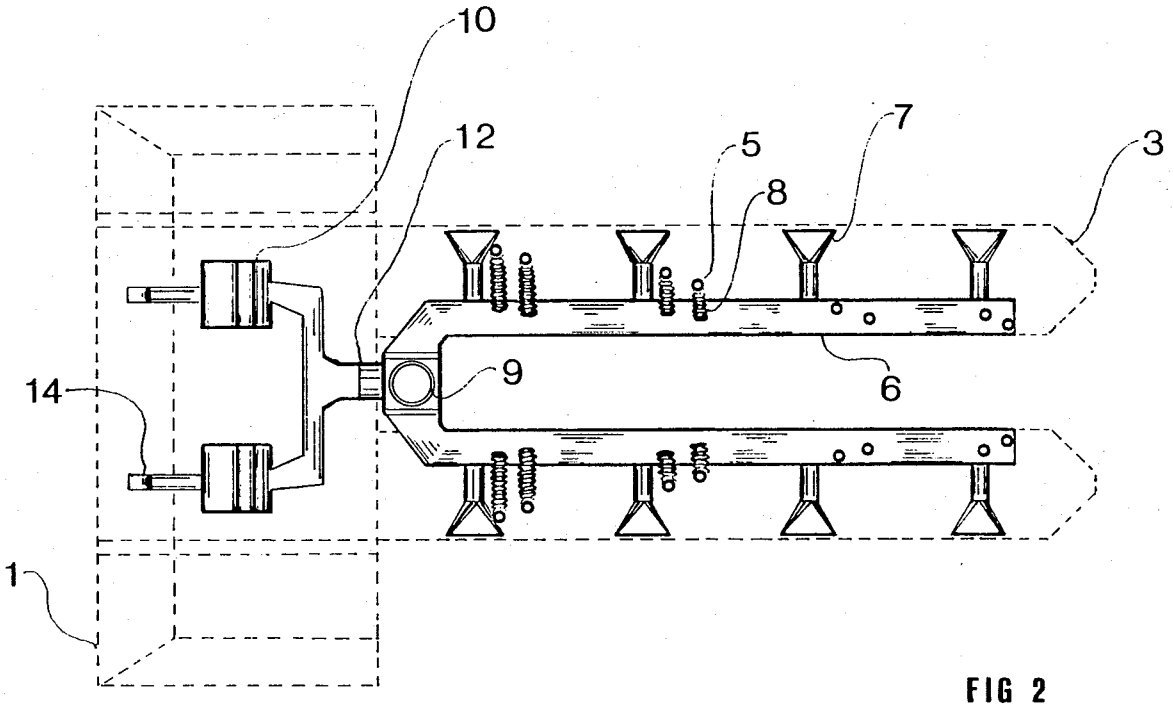
FIG. 2 is a schematic plan view of the apparatus of FIG. 1.

Referring firstly to FIGS. 1 and 2 of the drawings, there is shown in outline a conventional drawframe consisting of a box-like structure 1 within the upper part of which are rotatably mounted in tandem two sets of differential drafting rollers 2. Extending horizontally from the structure 1 is a pair of creel tables 3, each supported at the free end thereof by a respective leg 4. On each creel table 3 is disposed a set of eight bollards 5, each arranged to permit a respective sliver of material to be guided in parallel relationship along each creel table 3 towards a respective set of rollers 2.

Figure 3:
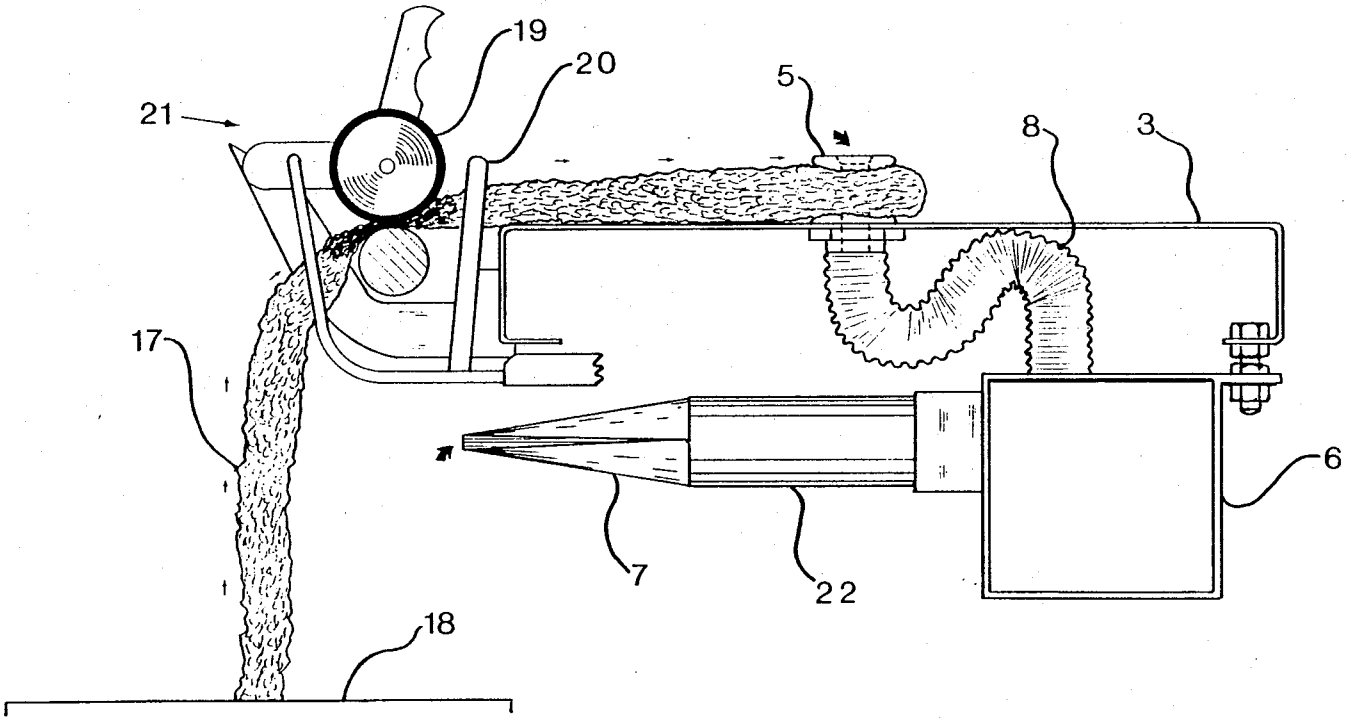
FIG. 3 is a more detailed and enlarged part-sectional view generally along the line x—x of FIG. 1.

Below each creel table 3 is disposed a hollow, elongate rectilinear duct 6 within which is set four mouth-like inlet vents 7. Above each duct 6 and beneath each bollard 5 is disposed an elastomeric convolute pipe 8 which provides a path through which air may be drawn into duct 6 from each bollard 5 (as shown in FIG. 3). The duct 6 is connected to an upright outlet duct 9 itself connected to a waste collection and filtration system capable of maintaining a constant volume and suction in operation. Waste collection is achieved by a rotary waste separator of the type comprising a rotatable gauze drum on one side of which waste from the duct 9 is deposited. As the drum slowly rotates such waste is scraped off and collected in a suitable receptacle such that blockage of the gauze is prevented. Air from the rotary waste separator is then fed to a filtration system in which fine particles of dust are removed. The filtration system is similar to the rotary waste separator but instead of having a gauze drum, is provided instead with a drum having a permeable membrane of a cloth material upon which dust etc. is deposited. Such dust is continuously removed as the drum rotates by a stripping system comprising a stripping nozzle which sucks the deposited dust from the cloth such that blockage of the membrane is prevented.

A pair of hood shaped top inlet vents 10 are provided above each set of the drafting rollers 2 and are connected via elbow-shaped ducts 11 to a semi-circular duct 12 fixed to the base of the outlet duct 9 below its junction with the duct 6. Similarly, a pair of bottom inlet vents 13 are fixed below each set of drafting rollers 2 and are also connected to the semi-circular duct 12.

Adjacent to the front of each set of drafting rollers 2 in the vicinity where slivers exit therefrom are further inlet vents 14, also connected by ducting 15 to the semi-circular duct 12.

The lower end of the outlet duct 9 adjacent the semi-circular duct 12 is provided with a damping plate 16 which is slidable within a slot in the outlet duct 9 to restrict, if necessary, the flow of air through the duct 12. Preferably, the duct 6 is tapered towards its end remote from the duct 9. Thus by carefully adjusting plate 16, an even distribution of the suction can be achieved to ensure adequate air flows through the various inlet vents.

Referring now to FIG. 3 of the drawings, a sliver of cotton 17 is shown being drawn from a sliver can 18 through a conventional tensioning roller 19 and a movable guide-fork 20 fixed to the creel table 3. The tensioning roller 19 is itself pivotally secured to a movable arm 21 which ensures that the drawframe is deactivated whenever the sliver 17 becomes entangled or broken. From the guide-fork 20, the sliver 17 is drawn by the drafting roller assembly 2 (shown in FIGS. 1 and 2) around one of the bollards 5. The bollard 5 is provided according to this aspect of the invention with a vertical and central through bore (shown in outline) with a tapered inlet and is connected to one end of the flexible pipe 8 which is itself connected to the elongate recilinear duct 6. Air and dust particles etc. can thus be drawn from around the bollard 5 into the ducting assembly in the direction of the arrows.

A mouth-like inlet vent 7 is mounted on a tube 22 by which it is connected to the duct 6 and in a similar manner to the bollard 5, the vent 7 can draw in air and dust etc, in the direction of the arrow, from around the sliver can 18, tensioning roller 19 and in particular the guide-fork 20.

In operation, a set of sliver cans is placed beneath each creel table 3 and from each can a sliver is fed through a respective guide-fork 20, around a bollard 5 and through one of the sets of drafting rollers 2. The dust generated by the movement, change in direction and drafting of the slivers is removed from around the drawframe by the extractor fan through the vents 5, 7, 10, 13 and 14.

Figure 4:
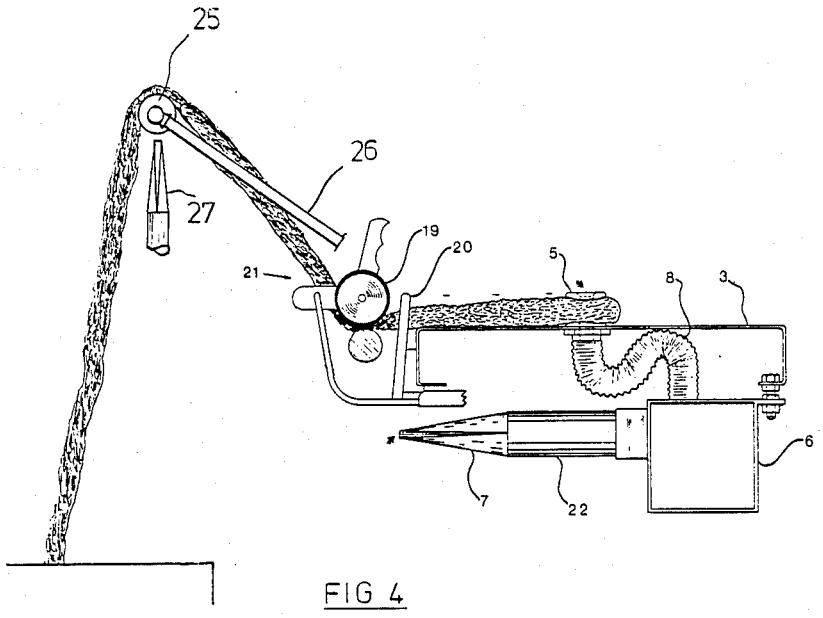
FIG. 4 is a view similar to FIG. 3 of a modified form of the apparatus.

Referring now to FIG. 4, on some drawframe apparatus the sliver 17 passes over an elevated assisting bar 25 mounted on arms 26 which are attached to and extend outwardly from creel table 3. This arrangement is provided for directing a sliver from a sliver can which is spaced outwardly from the tensioning rollers 19. Since the sliver is caused to change direction sharply as it passes over the assisting bar 25, dust and fibrous material are generated at this point. For this purpose, a further inlet vent 27 is provided close to the assisting bar, and may be connected to duct 6 in a manner similar to the connection of vents 7, or to a supplementary duct (not shown).

Figure 5:
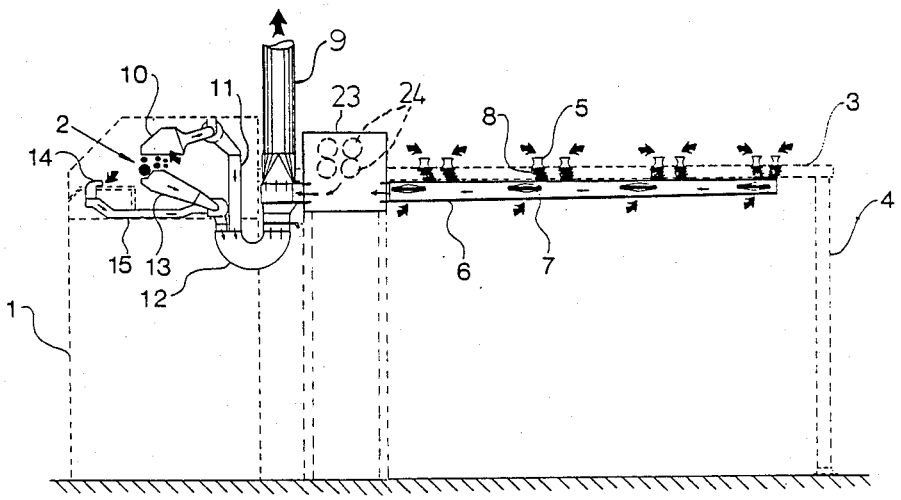
FIG. 5 is a view similar to FIG. 1 of a further modified form of the apparatus.

Referring now to FIG. 5, there may be provided a device known as an auto-leveller 23 including sets of rollers 24 through which the sliver passes between bollards 5 and drafting rollers 2. The purpose of this equipment is to ensure uniform density within the sliver as it approaches the drafting rollers. Here again, there is a considerable amount of dust and fibre generated as the sliver passes through the rollers 24, and so the interior of the device 23 is connected to duct 6 to ensure removal of the dust. Alternatively, a separate inlet vent within the device 23 may be independently connected to the duct 6 or to the semi-circular duct 12, or to outlet duct 9.

In effect, any position along the path of the sliver as it travels through the drawframe, where the sliver changes direction or where for some other reason there is found to be a generation of dust and fibre, can be afforded means for collecting the dust at that point and connected to the extraction system. By providing a number of individual dust collection devices at each position where dust is generated, adequate removal is ensured for maintaining a clean environment for the operator.

It will be apparent from the arrangement described that the apparatus according to the present invention does not hinder free access to the drawframe by the operator, since it is disposed substantially below the working surface of the drawframe.

Tests have shown that the ducting system can efficiently remove dust etc. from around the drawframe, as described below. The United Kingdom Health and Safety Executive have set a maximum recommended dust level within atmosphere to be breathed by an operator of the machine of 0.5 mg/m$^3$ (for cotton). However, in tests utilising conventional dust removal systems, the dust level in the atmosphere has been found to be substantially higher than this recommended maximum, particularly around the area of the creel tables. Shown below are the results of one set of tests to determine the environmental dust levels around a conventional drawframe in standard operating conditions and under full production, as shown in Table 1.

TABLE 1

| | DUST LEVELS (mg/m$^3$) | |
|---|---|---|
| TEST NO. | Around creel tables | Around drafting rollers |
| 1 | 1.535 | 0.545 |
| 2 | 1.61 | 0.46 |
| 3 | 2.205 | 0.55 |
| 4 | 2.25 | 0.555 |
| 5 | 2.085 | 0.38 |

It will be seen from the results of the above tests that environmental dust levels surrounding a conventional drawframe in standard operating conditions are generally significantly higher than the maximum recommended by the Health and Safety Executive. However, when apparatus according to the present invention was fitted to the same machine, the following results wee obtained, as shown in Table 2.

TABLE 2

| TEST NO. | DUST LEVELS ($mg/m^3$) Around creel tables | Around drafting rollers |
|---|---|---|
| 1 | 0.14 | 0.10 |
| 2 | 0.15 | 0.08 |
| 3 | 0.15 | 0.10 |
| 4 | 0.14 | 0.10 |

In the tests conducted in respect of the apparatus according to the present invention, the total air flow was approximately 27 $m^3$ per minute. Such an air flow is comparable to the air flow presently utilised in conventional extraction apparatus but, as can be seen from the Tables, a significant improvement in the efficiency of dust extraction from the environmental atmosphere is achieved utilising the present invention.

It will be appreciated that the invention is not limited to the particular embodiment as described and, for example, instead of utilising the through-bore through each bollard 5, there may instead by provided on each creel table 3 a series of holes which are strategically placed to permit removal of dust etc. from the atmosphere and which are connected by ducting to the elongate rectilinear duct 6 beneath the creel table.

Furthermore, the precise arrangement of the various parts of the drawframe is not a part of the present invention which is thus not intended to be limited to the above examples alone.

What is claimed is:

1. Dust extraction apparatus on a drawframe, the apparatus comprising guide means mounted on an axis to cause a change of direction of a sliver and a plurality of individual air inlet vents disposed at a plurality of spaced positions about the drawframe along a sliver path where dust and other pollutant particles may be generated, and connected via outlet ducting to one or more suction and collection means adapted continuously to remove particles from the surrounding air, characterised in that at least some of said air inlet vents are disposed so as to extend along the axis of said guide means so that free access to operating parts of the drawframe is not hindered thereby.

2. Apparatus according to claim 1, including at lest one creel table having guide means in the form of bollards having means defining a through bore extending along the axis thereof, air inlet vents on each creel table at or around each bollard, and at or around each guide-fork, and further air inlet vents at or around the or each set of differential drafting rollers, wherein at least some of said air inlet vents extend through and along the axes of the bollards.

3. Apparatus according to claim 1, in which suction in the outlet ducting is substantially constant such that particles are removed from the air of the outlet ducting at a substantially constant rate.

4. Apparatus according to claim 1, in which the inlet vents on each creel table are connected to outlet ducting fixed below each table.

5. Apparatus according to claim 4, in which the outlet ducting is tapered in cross-section to ensure adequate air flows through the various inlet vents connected thereto.

6. Apparatus according to claim 1, in which each bollard comprises an air inlet vent, having a bore therein through which air may be drawn into the ducting.

7. Apparatus according to claim 6, in which said bore extends vertically and centrally through said bollard and has a tapered inlet.

8. Apparatus according to claim 1, comprising air inlet vents at or around at least one sliver assisting bar attached to each creel table.

9. Apparatus according to claim 1, including means whereby the interior of an auto-leveller device positioned between the creel table and the differential drafting rollers for controlling the density of a sliver passing thereto, is connected to said outlet ducting for the removal of particles from said device.

10. Apparatus according to claim 1, including damping means in the outlet ducting to control the air flow therein for optimum performance with a variety of sliver materials.

11. Apparatus according to claim 10 in which the damping means is operable between the drafting roller vents and the creel table vents such that air flow from the drafting roller vents can be controlled.

* * * * *